US008221055B1

(12) United States Patent
Liang

(10) Patent No.: US 8,221,055 B1
(45) Date of Patent: Jul. 17, 2012

(54) TURBINE STATOR VANE WITH ENDWALL COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 647 days.

(21) Appl. No.: 12/499,684

(22) Filed: Jul. 8, 2009

(51) Int. Cl.
*F01D 25/12* (2006.01)

(52) U.S. Cl. ..... 415/115

(58) Field of Classification Search ..... 415/115, 415/191, 211.2
See application file for complete search history.

(56) References Cited

U.S. PATENT DOCUMENTS 6,644,920 B2 * 11/2003 Beeck et al. ..... 416/97 R
6,719,529 B2 * 4/2004 Tiemann ..... 416/97 R
7,097,417 B2 * 8/2006 Liang ..... 415/115
8,133,024 B1 * 3/2012 Liang ..... 416/1

* cited by examiner

*Primary Examiner* — Ninh H Nguyen
(74) *Attorney, Agent, or Firm* — John Ryznic

(57) ABSTRACT

A turbine stator vane with an ID endwall and an OD endwall and a vane airfoil extending between the two end walls. Each endwall has formed within a forward section a vortex tube arrangement of two separated vortex tubes that extend from one side of the endwall to the opposite side, and each of the separated vortex tubes are connected by a row of feed holes to supply cooling air and each is connected by a row of discharge slots to discharge a layer of film cooling air in front of the airfoil leading edge. The feed holes and the discharge slots are offset from the tube central axis in order to generate a vortex flow within the tubes. The vortex tubes are also connected with mate face cooling air holes to discharge some of the vortex flow cooling air onto the two mate faces of the enwalls to provide sealing and cooling for the spacing between adjacent endwall mate faces.

14 Claims, 4 Drawing Sheets

TURBINE STATOR VANE WITH ENDWALL COOLING

FEDERAL RESEARCH STATEMENT

None.

CROSS-REFERENCE TO RELATED APPLICATIONS

None.

BACKGROUND OF THE INVENTION

1. Field of the Invention

The present invention relates generally to a gas turbine engine, and more specifically to an air-cooled turbine stator vane with endwall leading edge cooling.

2. Description of the Related Art Including Information Disclosed Under 37 CFR 1.97 and 1.98

In a gas turbine engine, a high temperature gas flow is passed through the turbine to produce mechanical work to drive the compressor and, in an industrial gas turbine engine, to also drive an electric generator and produce electrical energy. Passing a higher temperature gas flow into the turbine can increase the efficiency of the engine. However, the turbine inlet temperature is limited by the material properties of the first stage stator vanes and rotor blades as well as the amount of cooling that can be produced by passing cooling air through these airfoils (vanes and blades). Airfoil designers try to minimize the amount of cooling air used in the airfoils since the cooling air is typically bled off from the compressor and thus is not used to produce work and the energy used to compress the air is thus wasted.

A row of segmented guide vanes are located directly upstream of a row of rotor blades and function to redirect the hot gas flow into the rotor blades. FIG. 1 shows a prior art guide vane for a large industrial gas turbine engine. A bow wave driven hot gas flow ingestion phenomenon is created when the hot gas core flow entering the vane row where the leading edge of the vane forms a local blockage that creates a circumferential pressure variation at the intersection of the airfoil leading edge location. The leading edge of the turbine stator vane generates an upstream pressure variation that can lead to hot gas ingress into a front gap. If proper cooling or design measures are not undertaken to prevent this hot gas ingress, the hot gas ingress can lead to severe damage to the front edges of the vane endwall as well as the sealing material between adjacent vane segments such as honeycomb under the ID (inner diameter) endwall.

FIG. 1 shows a general schematic view of the bow wave effect ahead of the turbine vanes. The high pressure ahead of the vane leading edge is greater than the pressure inside of the cavity. This leads to causes a radial inward flow of the hot gas into the cavity. The ingested hot gas flows through the gap circumferentially inside of the cavity and towards the lower pressure zones, and finally outflow of the hot gas at locations where the cavity pressure is higher than the local hot gas flow pressure.

In general, the size of the bow wave is a strong function of the vane leading edge diameter and the distance of the vane leading edge to the endwall edge. Since the pressure variation in the tangential direction within the gap is sinusoidal, the amount of hot gas flow penetrating the axial gap increases linearly with the increasing gas width. Thus, it is important to reduce the axial gas width to a minimum allowable by the tolerance limits in order to reduce the hot gas ingress.

The high heat transfer coefficient and high gas temperature region caused by the above-described bow wave ingress hot gas flow associated with turbine vane endwall leading edge region can be alleviated by incorporating a new and effective direct vortex cooling with discrete film discharge slots of the present invention into the prior art endwall leading edge cooling design for the stator vanes.

BRIEF SUMMARY OF THE INVENTION

It is an object of the present invention to provide for a turbine stator vane with leading edge endwall cooling that will alleviate the undesirable effects of the bow wave ingress hot gas flow problem of the cited prior art turbine stator vanes.

These objectives and more are achieved in the turbine stator vane with leading edge cooling circuit of the present invention that includes two discrete vortex tubes located at the vane endwall leading edge corner. Cooling air is injected into the vortex tubes at a location offset from the axis of the vortex tubes to generate a vortex flow of cooling air within the vortex tube. Multiple resupply of cooling air is injected into the vortex tube periodically at the beginning of the vortex tube to enhance the strength of the vortex flow. This repeated process would achieve a high rate of heat transfer coefficient within the vortex tube. A portion of the air is discharged at a mate face spacing in-between adjacent end walls. A majority of the spent cooling air is discharged into the vane endwall in front of the vane airfoil leading edge to provide additional film cooling for the endwall as well as to dilute the incoming hot gas flow.

DETAILED DESCRIPTION OF THE INVENTION

Figure 1:
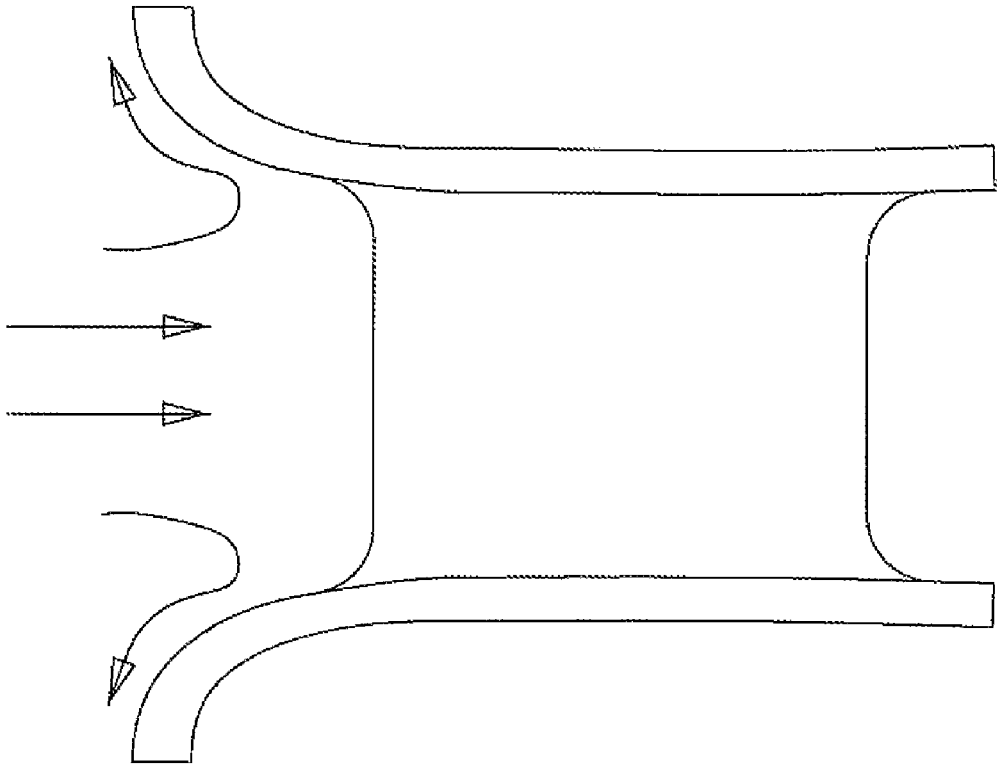
Fig 1 Prior Art
FIG. 1 shows a cross section side view of a prior art turbine stator vane with arrows representing the bow wave effect in front of the vane leading edge region.
Figure 2:
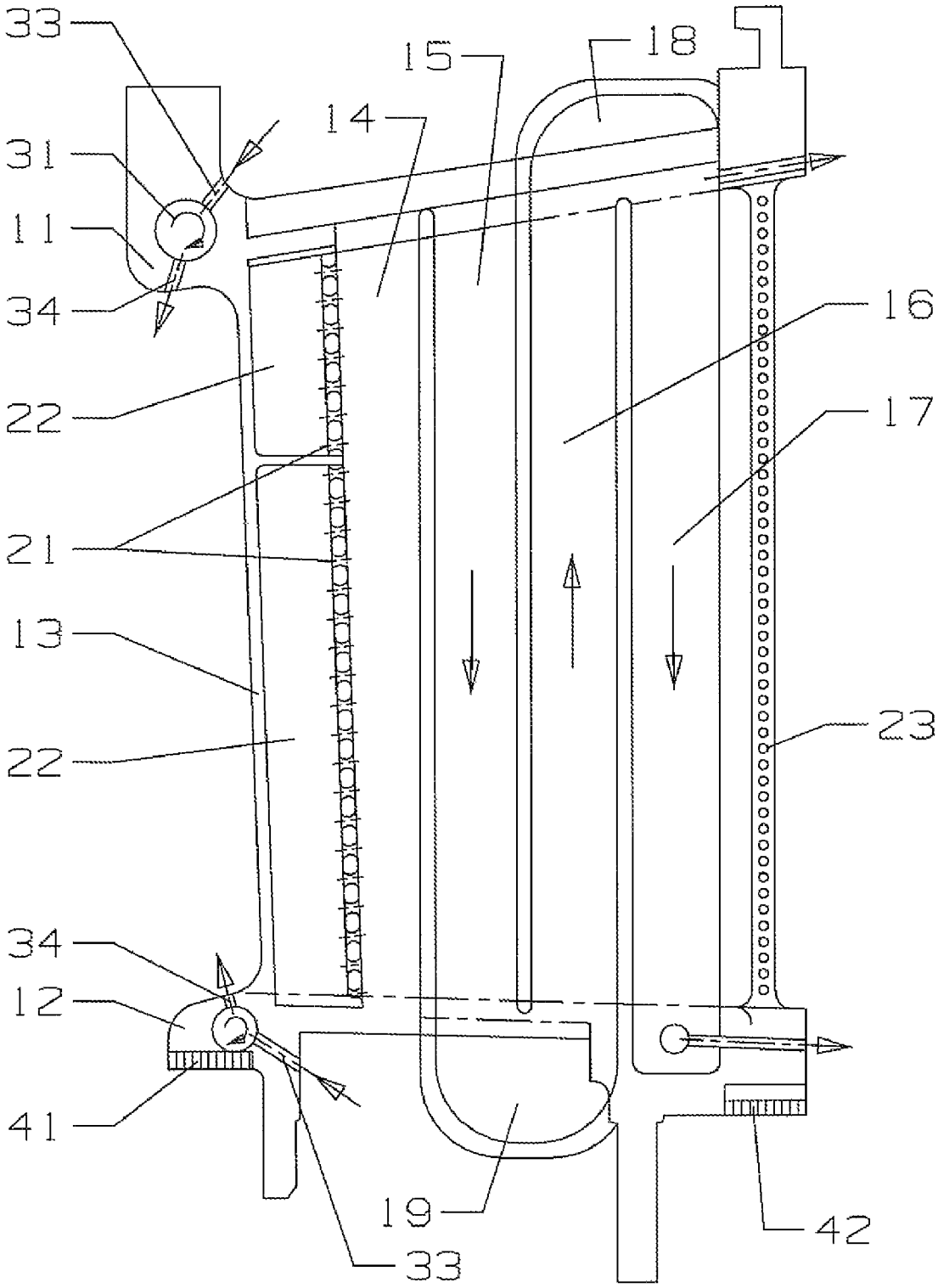
FIG. 2 shows a perspective view of an endwall cooling circuit with vortex tubes of the present invention.

The present invention is intended for a large gas turbine engine but could also be used for smaller engines or in an aero engine as well for the stator vane end walls. FIG. 2 shows a stator vane with the cooling circuit of the present invention. The vane includes an OD (outer diameter) endwall 11 with forward and aft hooks to secure the vane segment to a carrier ring, an ID (inner diameter) endwall 12, and the vane airfoil 13 extending between the two end walls 11 and 12. To provide cooling for the vane airfoil, a leading edge cooling air supply channel 14 is located in the leading edge region and a serpentine flow cooling circuit with a first leg 15 to supply the cooling air is located adjacent to the channel 14. In this particular cooling circuit to serpentine flow circuit is a 3-pass serpentine flow circuit with a second leg 16 and a third leg 17 connected in series with the first leg or supply channel 15 to form the serpentine and provide cooling for the remainder of the airfoil 13. An outer diameter tip turn 18 and an inner diameter tip turn 19 connect the legs of the serpentine flow circuit. Exit holes in the aft sections of the two end walls discharge cooling air from the serpentine flow circuit to provide additional cooling for the aft ends of the two end walls as seen in FIG. 2.

Two impingement cavities 22 are connected to the leading edge channel 14 through a row of metering and impingement holes 21 to provide impingement cooling to a backside wall of the leading edge of the airfoil 13. A showerhead arrangement of film cooling holes can be connected to the two impingement cavities 22 to discharge the spent impingement cooling air and provide additional cooling to the airfoil through a layer of film air on the external surface. A row of trailing edge exit slots 23 are used to provide additional cooling for the trailing edge region and to discharge the spent cooling air from the serpentine flow circuit.

Figure 3:
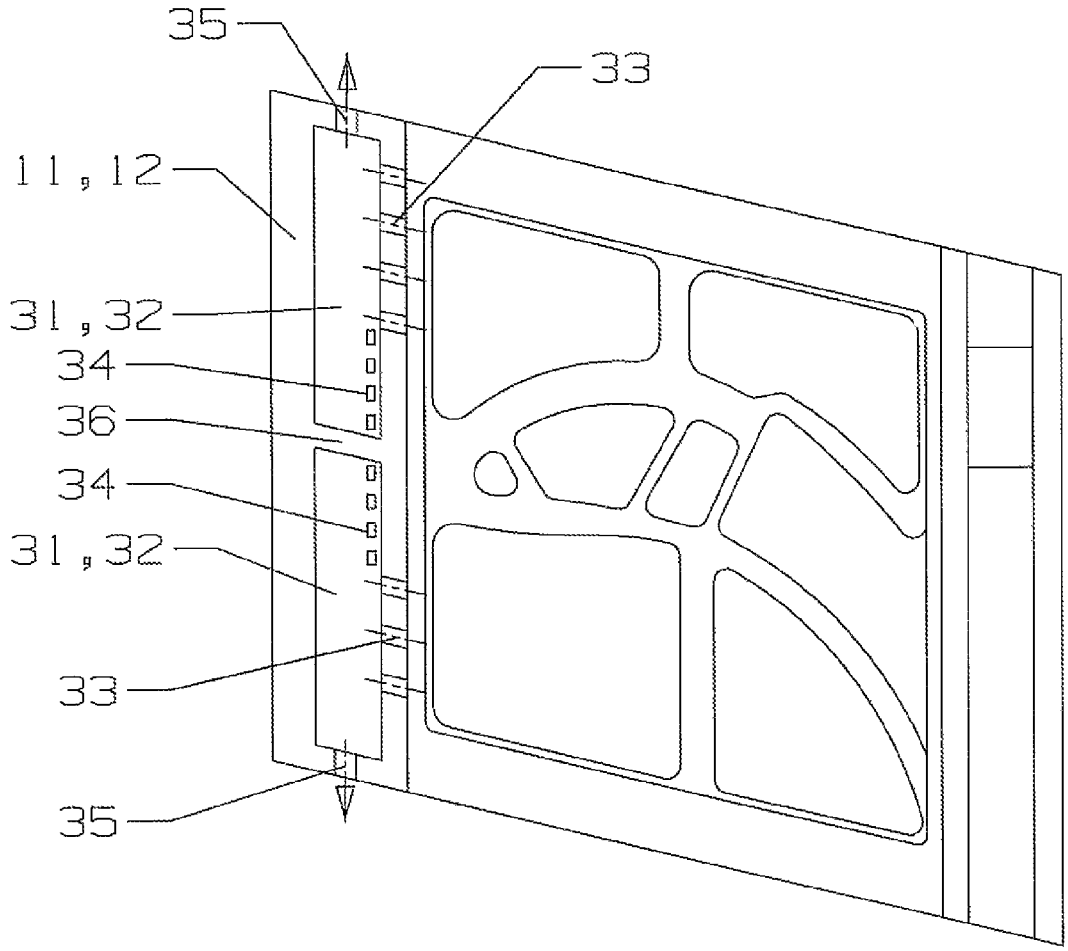
FIG. 3 shows a cross section top view of the vane endwall with the vortex tubes of the present invention.

Two vortex tube arrangements are used to provide cooling to the end walls in the leading edge region and to prevent the bow wave effect described above. An OD vortex tube 31 is formed in the leading edge section of the OD endwall 11 and an ID vortex tube 32 is formed in the leading edge section of the ID endwall 12. Each vortex tube 31 and 32 are supplied with cooling air through feed holes 33 and discharge cooling air through film slots 34. The feed holes 33 and film slots 34 are aligned with the vortex tubes 31 and 32 to produce a vortex flow within the vortex tubes 31 and 32 by offsetting the feed holes and film slots away from the axis of the vortex tubes and tangent to the tube surfaces. As seen in FIG. 3, the two sets of film slots 34 are located upstream of and on the two sides of the leading edge of the airfoil with one set on the pressure side and the other set on the suction side of the leading edge from a stagnation point.

ID honeycombs are used to provide a sealing surface for the vane between rotating parts of the turbine such as finger seals extending from a platform of the adjacent rotor blades. A forward ID honeycomb 41 and an aft ID honeycomb seal 42 is used in this embodiment. Other sealing arrangements can be used without departing from the filed or scope of the invention.

FIG. 3 shows another view of the vortex tube arrangement. The vortex tubes 31 and 32 are shown extending along the forward endwall 11 and 12 from end to end. In this embodiment, two tubes extend between the two ends. However, in other embodiments other arrangements can be used such as one long tube or more than two tubes. Connected to each vortex tube 21 and 32 is a short row of the discharge slots 34 which are arranged along the inner ends of the vortex tubes 31 and 32 as seen in FIG. 3. Mate face discharge holes 35 connect the vortex tubes 31 and 32 to the mate face surfaces and discharge the cooling air from the vortex tubes. The feed holes 33 are located within the vortex tube between the discharge slots 34 and the mate face discharge holes 35. The feed holes 33 are on one side of the vortex tube while the discharge slots are on another side so that the feed holes do not overlap within the vortex tube with the discharge slots.

Figure 4:
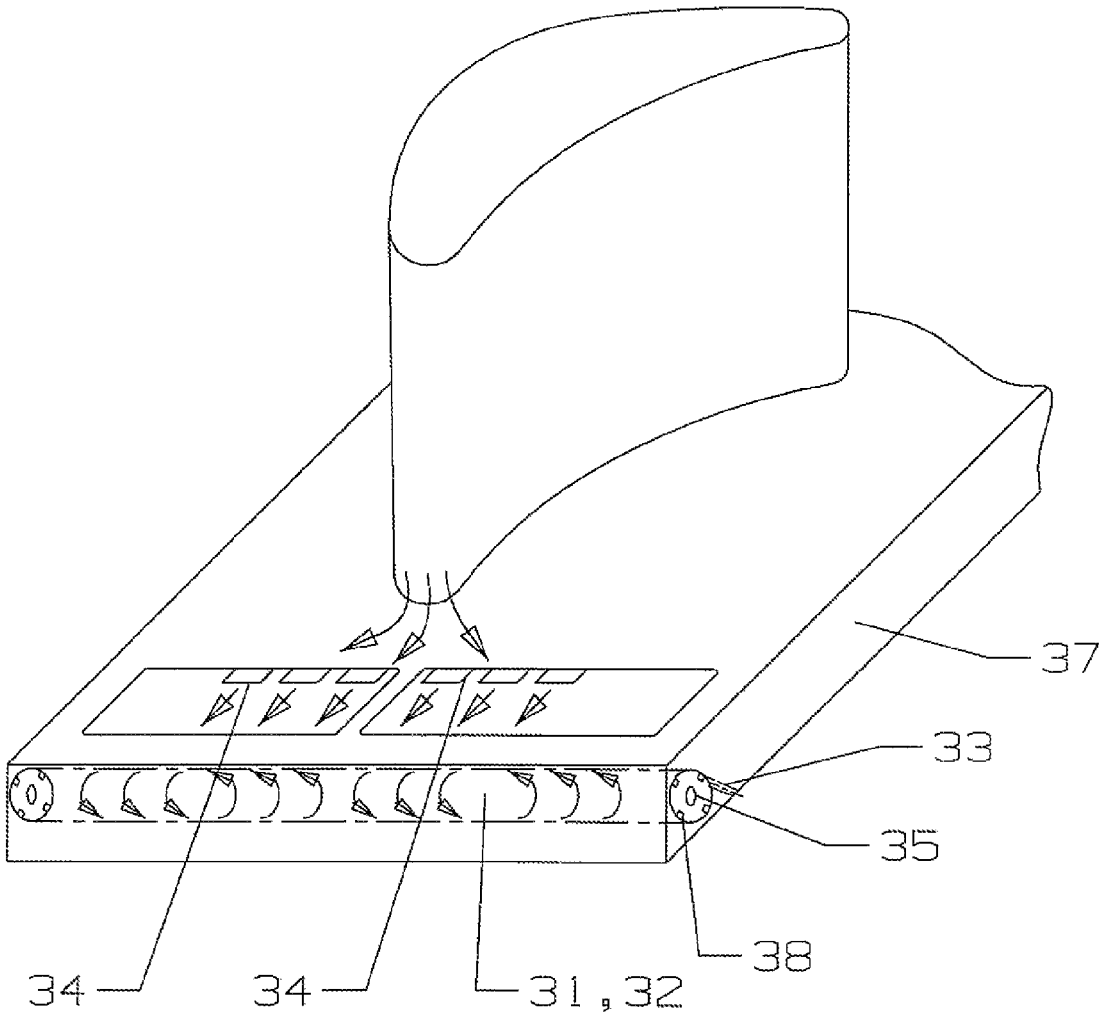
FIG. 4 shows a cut-away view of the vane endwall vortex cooling tubes of the present invention.

FIG. 4 shows a cut-away view of the end wall vortex tubes used to cool the vane end walls and prevent the bow wave effect from occurring. The endwall leading edge includes the vortex tube 31 or 32 depending upon which endwall is shown (ID or OD) since both include the same cooling path structure. The three curved arrows on the lower side of the leading edge of the airfoil represent the hot gas down draft flow. The endwall mate face 37 is shown with the mate face exit hole 35 opening from the vortex tube end to discharge the cooling air from the vortex tube 31 and 32. Trip strips 38 are arranged along the surface of the vortex tube to promote heat transfer from the hot metal to the cooling airflow. The ID vortex tube and cooling circuit is of the same structure as the OD vortex tube and cooling circuit. Each vortex tube is formed with two separate tubes and each is connected to the feed holes 33 and discharge the cooling air onto an outer surface of the respective endwall surface through the film slots 34. Outer ends of the vortex tubes include the mate face discharge holes 35

Thus, the high heat transfer coefficient and high gas temperature region caused by the bow wave ingress hot gas flow problem associated with turbine endwall leading edge regions can be alleviated with the direct vortex cooling with discrete film discharge slots of the present invention into the prior art endwall leading edge cooling circuit.

Two discrete vortex tubes are constructed at the vane end wall leading edge corner. Cooling air is injected into the vortex tube at a location offset from the axis of the vortex tube. This generates a vortex flow within the vortex tube. In addition, multiple re-supply cooling air can be injected into the vortex tube periodically at the beginning of the vortex tube to enhance the strength of the vortex flow. This repeated process would achieve a high rate of heat transfer coefficient within the vortex tube. A portion of the air is discharged from the vortex tube at the mate face spacing in-between the endwall. A majority of the spent cooling air is discharged into the vane endwall in front of the vane airfoil leading edge to provide additional film cooling for cooling of the endwall as well as to dilute the incoming hot gas flow. One partition 36 is used to separate the vortex tube into two separated cooling zones and form vortex tube compartments. Separating the vortex tube into compartments will minimize the pressure gradient effect for the cooling flow mal-distribution. Micro pin fins or trip strips 38 can be used on the inner surface of the vortex tube to enhance the internal heat transfer performance of the vortex tubes.

In operation, cooling air from the endwall cooling supply cavity is injected periodically into the forward section of the vortex tube. In order to generate a high strength vortex flow field within the vortex tube, the cooling air is injected at an offset location from the central axis of the vortex tube. This vortex flow generation process will create a high internal heat transfer capability for cooling of the endwall leading edge location. The spent cooling air is then discharged onto the endwall to provide a film layer or dilution air for cooling of the endwall and gap between adjacent endwall mate faces. Since the film cooling slot is located at the high pressure region in front of the vane airfoil leading edge, the spent cooling air flow will migrate into the spacing between the vane and the blade. The result is a lower heat load level on the end wall edge and the metal temperature for the vane end wall.

I claim the following:

1. A turbine stator vane comprising:

an OD endwall and an ID endwall;

a vane airfoil extending between the OD endwall and the ID endwall;

an internal airfoil cooling circuit to provide cooling for the airfoil;

a vortex tube formed within a forward section of the OD endwall and the ID endwall, the vortex tube extending from one side of the endwall to the opposite side of the endwall;

a row of cooling air feed holes connected to an endwall cooling air supply cavity and opening into the vortex tube;

a row of cooling air discharge slots connected to the vortex tube on a side away from the feed holes and opening onto an external surface of the endwall; and, the feed holes and the discharge slots are offset from a central axis of the vortex tube such that a vortex flow of cooling air is formed within the vortex tube.

2. The turbine stator vane of claim 1, and further comprising:

the row of discharge slots is located upstream of and near to a leading edge of the vane airfoil.

3. The turbine stator vane of claim 1, and further comprising:

a mate face discharge cooling hole connected to the vortex tube and opening onto the mate face of the endwall to discharge cooling air from the vortex tube and into a gap between adjacent mate faces of adjacent stator vane end walls.

4. The turbine stator vane of claim 3, and further comprising:

a partition separates the two vortex tubes and where the partition is located in front of the airfoil leading edge; and, the discharge slots for the two vortex tubes are located on the side of the vortex tube where the partition is located.

5. The turbine stator vane of claim 1, and further comprising:

the ID vortex tube and the OD vortex tube are both formed as two separated vortex tubes each with a row of cooling air feed holes and discharge slots.

6. The turbine stator vane of claim 5, and further comprising:

the separated vortex tubes in each of the ID endwall and the OD endwall are both parallel to each other.

7. The turbine stator vane of claim 1, and further comprising:

the vortex tubes include pin fins or trip strips along an inner surface to promote heat transfer to the cooling air flow.

8. The turbine stator vane of claim 1, and further comprising:

the cooling air feed holes and displaced from the discharge slots within the vortex tube so that they do not overlap.

9. The turbine stator vane of claim 1, and further comprising:

the vortex tubes are circular in cross sectional shape.

10. A process for cooling a forward endwall of a stator vane used in a gas turbine engine, the stator vane including an ID endwall and an OD endwall and a vane airfoil extending between the two end walls, the process for cooling comprising the steps of:

supplying cooling air to an endwall cooling air supply cavity of the vane;

feeding cooling air from the endwall cooling air supply cavity to form a vortex flow of cooling air within a forward section of the vane ID and OD end walls;

discharging most of the vortex flowing cooling air onto an outer surface of the end walls in front of a leading edge of the vane airfoil as a layer of film cooling air; and, discharging the remaining vortex flow cooling air onto a mate face surface of the vane endwall.

11. The process for cooling the forward endwall of claim 10, and further comprising the step of:

discharging the vortex cooling air from the vortex tube toward an oncoming hot gas flow passing through the stator vane.

12. The process for cooling the forward endwall of claim 10, and further comprising the step of:

feeding cooling air into the vortex flowing cooling air on one side of the vortex flow and discharging the vortex flowing cooling air on an opposite side of the vortex flowing cooling air.

13. The process for cooling the forward endwall of claim 12, and further comprising the step of:

discharging each of the separated vortex flows out through an adjacent mate face of the endwall.

14. The process for cooling the forward endwall of claim 10, and further comprising the step of:

forming two vortex flows in each endwall with a separation between the two vortex flows occurring in front of the leading edge of the vane airfoil.

* * * * *